US007326033B2

(12) United States Patent
Boegli et al.

(10) Patent No.: US 7,326,033 B2
(45) Date of Patent: Feb. 5, 2008

(54) TURBOMACHINE BLADE

(75) Inventors: Andreas Boegli, Vogelsang-Turgi (CH); Alexander Mahler, Kreuzlingen (CH); James Ritchie, Ennetbaden (CH); Slawomir Slowik, Stetten (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 11/600,754

(22) Filed: Nov. 17, 2006

(65) Prior Publication Data

US 2007/0104570 A1 May 10, 2007

Related U.S. Application Data

(63) Continuation of application No. PCT/EP2005/052198, filed on May 13, 2005.

(30) Foreign Application Priority Data

May 19, 2004 (DE) ..... 10 2004 025 321

(51) Int. Cl.
*F01D 11/02* (2006.01)

(52) U.S. Cl. ..... 415/173.1; 415/173.6

(58) Field of Classification Search ..... 415/173.3, 415/173.5, 173.6, 173.1; 416/194, 195
See application file for complete search history.

(56) References Cited

U.S. PATENT DOCUMENTS

| | | | |
|---|---|---|---|
| 2,278,041 | A | 3/1942 | Allen |
| 4,878,810 | A | 11/1989 | Evans |
| 5,048,183 | A | 9/1991 | Cang et al. |
| 5,083,903 | A | 1/1992 | Erdmann |
| 5,238,364 | A | 8/1993 | Kreitmeier |
| 5,290,144 | A | 3/1994 | Kreitmeier |
| 6,402,474 | B1 | 6/2002 | Okuno |
| 2003/0194322 | A1 | 10/2003 | Brandle et al. |
| 2004/0146404 | A1 | 7/2004 | Chantal et al. |

FOREIGN PATENT DOCUMENTS

| | | |
|---|---|---|
| DE | 199 04 229 A1 | 8/2000 |
| DE | 100 40 431 A1 | 4/2001 |
| EP | 1 262 633 B1 | 12/2002 |

OTHER PUBLICATIONS

International Search Report dated Aug. 31, 2005.
Written Opinion of the International Searching Authority.
International Preliminary Report on Patentability dated Aug. 28, 2006.
German Search Report dated Jul. 30, 2004 (with English translation of category of cited documents).

*Primary Examiner*—Edward K. Look
*Assistant Examiner*—Dwayne J White
(74) *Attorney, Agent, or Firm*—Buchanan Ingersoll & Rooney PC

(57) ABSTRACT

A turbomachine blade is disclosed having a shroud element, wherein plastic deformations and lifting of the shroud element on one side result during operation under centrifugal load. This load may result in high-temperature creep of the blade. A sealing strip which is arranged on the shroud element can be configured with a thickness varying in a circumferential direction. The mass of the shroud element and thus the asymmetrical centrifugal load and the lifting of the shroud element on one side resulting therefrom can be reduced by material removal at regions lying on the outside in the circumferential direction.

9 Claims, 3 Drawing Sheets

TURBOMACHINE BLADE

CROSS REFERENCE TO RELATED APPLICATIONS

This application claims priority under 35 U.S.C. § 119 to German Application 10 2004 025 321.8 filed in Germany on 19 May 2004, and as a continuation application under 35 U.S.C. § 120 to PCT/EP2005/052198 filed as an International Application on 13 May 2005 designating the U.S., the entire contents of which are hereby incorporated by reference in their entireties.

TECHNICAL FIELD

A turbomachine blade and a method of producing a turbomachine blade are disclosed.

BACKGROUND INFORMATION

The blading of turbomachines with blade shrouds is sufficiently known from the prior art. Blade shrouds are used on the one hand to mechanically couple the blade tip regions of adjacent blades to one another, thereby resulting in greater rigidity of the blade combination and thus in a higher natural vibration frequency. In addition, sealing bands in turbomachine blading also serve to reduce leakages at the blade tips. To this end, the shrouds also can carry sealing strips which interact with an opposed running surface and form together with the latter a non-contact seal, for example a labyrinth seal. The opposed running surface is often a "honeycomb structure" or another system that tolerates grazing.

The blade shrouds encircling at the circumference can include individual segments which are each integrally cast on the tip of a blade. In running blading, the arrangement of the shroud element results in increased loading of the blade root and of the airfoil on account of the centrifugal forces of the shroud element. Furthermore, the shroud elements need not be mounted centrally at the airfoil tip. This results in an additional bending load for the airfoil and in "tilting", that is to say lifting on one side, of the shroud element. Furthermore, it has been found that, even with balanced shroud elements, plastic deformations and thus "tilting" may occur in certain regions on account of the centrifugal force. In particular on account of this deformation, gaps may be produced between shroud elements, via which gaps hot gas is able to penetrate into the region above the shroud element. The centrifugal load, in particular in combination with the additional thermal loading, may result in plastic creep deformation. The elastic and plastic asymmetrical deformations referred to may result in a lack of sealing of the sealing gap and/or in excessive grazing of the sealing strips on the opposed running surface.

SUMMARY

An exemplary turbomachine blade is disclosed wherein asymmetrical loads caused by a centrifugal load of a shroud element, which may result in lifting of the shroud element, are reduced and/or avoided.

An exemplary shroud element, which relative to the median line of the airfoil can be arranged circumferentially asymmetrically at the tip-side end of the airfoil, can be configured such that the thickness of the sealing strip varies in the circumferential direction. In one embodiment, the thickness of the sealing strip in the regions lying on the outside as viewed in the installed circumferential direction is smaller than in the center region, which lies in the region of the airfoil. In this way, the mass of the sealing strip and thus of the shroud element can be reduced in particular at the locations which induce an especially high bending load at the transition to the airfoil, without reducing the strength at locations which are critical with regard to the strength, namely at the transition to the airfoil. The plastic deformation under centrifugal load is thus reduced or even completely prevented.

On the one hand, the reduced mass of the shroud element reduces the total centrifugal load at the blade root; on the other hand, due to the reduced mass moment of inertia of the shroud element relative to the airfoil median line, the bending moment, initiated under centrifugal load on account of the asymmetry of the shroud element, at the transition from the shroud element to the airfoil is reduced. Lifting or "tilting" of the shroud element on one side is reduced as a result. In an exemplary embodiment, the thickness of the sealing strip is varied in such a way that the mass moment of inertia of the shroud element relative to the airfoil median line is evened out. Owing to the fact that the product of mass and inertia radius of the shroud element relative to the airfoil median line is then identical in the installed circumferential direction of the turbomachine blade on each side of the airfoil median line, an asymmetrical centrifugal load is avoided. The airfoil is then no longer subjected to a bending load. Lifting or "tilting" of the shroud element on one side is completely avoided in this embodiment. Furthermore, the absolute reduction in the mass moment of inertia, which reduction turns out to be especially large if the mass reduction, in an exemplary embodiment, is effected at the regions lying on the outside in the circumferential direction, results in a further reduction or in complete avoidance of local plastic deformations at the transition to the airfoil.

Exemplary embodiments can be realized on existing turbomachine blades in a very simple manner by the sealing strip being subsequently machined, for example by milling, grinding or electrical discharge machining. An exemplary embodiment can thus be realized in existing turbomachines without having to redesign the tools for the production of the turbomachine blades. Furthermore, it is also possible for blades which are already in use to be subsequently machined in the course of maintenance work.

In an exemplary embodiment, an upstream sealing strip, which lies adjacent to the airfoil leading edge, and an downstream sealing strip, which is arranged adjacent to the airfoil trailing edge, are arranged on the shroud element. In this embodiment, the thickness of the upstream sealing strip can vary.

In an embodiment, the sealing strip has a greater thickness in the region of the airfoil than in the positions lying on the outside as viewed in the installed circumferential direction. The region of reduced thickness of the sealing strip is, for example, 20% to 70% of the extent the sealing strip in the installed circumferential direction.

To produce a turbomachine blade according to an exemplary embodiment, it may on the one hand be produced at the primary forming stage, that is to say during the casting for example, with a sealing strip having a thickness varying in the circumferential direction. This method is readily feasible in the case of the completely new design of a turbomachine blade. A further possibility of producing a turbomachine blade involves machining an existing turbomachine blade and in reducing the thickness of the sealing strip in the regions lying on the outside in the circumferential direction. This reduction is achieved by machining for example, the mass of the sealing strip being reduced by 10% to 50% of the original mass by the machining. The mass reduction can also help to reduce the centrifugal load at the blade root. The subsequent machining of an existing blade makes it possible to implement an exemplary embodiment in already existing designs. Furthermore, blades which are already in use can be modified as described herein in the course of regular maintenance work.

Further embodiments will be revealed to the person skilled in the art from the description below of the exemplary embodiments.

BRIEF DESCRIPTION OF THE DRAWINGS

Exemplary embodiments are explained in more detail below with reference to exemplary embodiments illustrated in the drawing, in which, in detail.

Details which are not essential for the understanding have been omitted. The exemplary embodiments serve for the better understanding of the invention and are not to be used for restricting the invention.

DETAILED DESCRIPTION

Figure 1:
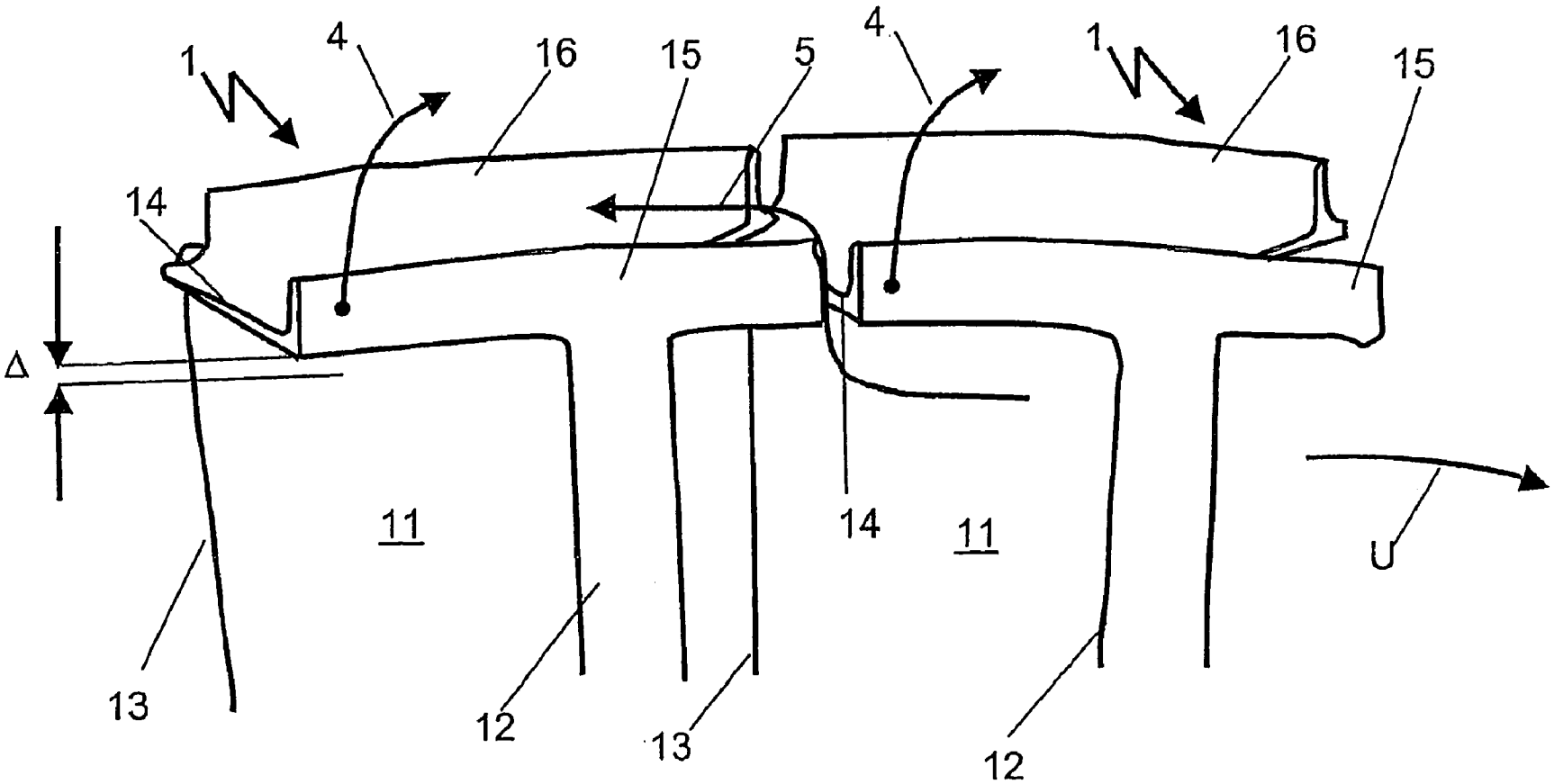
Fig. 1 Prior Art
FIG. 1 shows blades of a known turbomachine.

A detail of the moving blading of a turbine according to the prior art is shown in FIG. 1. Here, the tip regions of two adjacently arranged moving blades 1 are shown.

Each of the moving blades 1 comprises a blade root, which is not shown but is familiar to the person skilled in the art and which comprises a fastening device with which the moving blade is fastened in the rotor of a gas turboset or steam turbine. Each of the moving blades has an installed circumferential direction, which is represented by the rotational speed U, and an installed radial direction, which points from the blade root to the blade tip. Furthermore, a moving blade comprises an airfoil 11 with an airfoil leading edge 12 and an airfoil trailing edge 13.

During operation of the turbomachine, a hot-gas flow flows through the blade cascade, formed by the blades, from the airfoil leading edge to the airfoil trailing edge. The moving blade shown has a "blade shroud", which surrounds the moving blade row as a ring. Leakages at the blade tips are avoided by the arrangement of the shroud.

Furthermore, the shroud mechanically couples the blades at the blade tips in such a way that the vibration mode of the blading is the vibration mode of a packet vibration at which a plurality of blades vibrate in phase. This results in greater rigidity of the blading and in a markedly increased natural vibration frequency compared with the vibrations of an individual blade. The shroud is formed by shroud elements 14, which are arranged at the tip of each blade. Radial sealing strips running in the circumferential direction, to be precise an upstream sealing strip 15 and an downstream sealing strip 16, are arranged on the shroud elements 14. In a manner known per se, the sealing strips together with the casing parts which are opposite them in the fitted state form a non-contact labyrinth seal. The shroud elements are, as it were, mounted on the airfoils 11.

In the desired installation position, the circumferential end faces of the shroud elements of two adjacent blades bear against one another and form an essentially gas-tight unit in such a way that no hot gas can flow outward from the throughflow passages of the blade cascade. During operation of the turbomachine, the blades shown move in the direction of the arrow designated by U.

In the process, the blades and in particular the shroud elements are loaded by centrifugal forces acting radially outward, that is to say in the direction of the blade tip. The centrifugal forces which act on the shroud elements can be absorbed in the airfoils. On account of the complex stress states influenced by centrifugal forces and thermal deformations, local plastic deformations occur at the transition from the shroud element to the airfoil under unfavorable circumstances.

On the pressure side, the shroud element is moved radially outward in the process by the quantity A. This deformation of the blade and the movement of the shroud element resulting therefrom potentially result in a gap between two adjacent shroud elements. A hot-gas leakage 5 can pass through this gap into a region above the shroud elements. This ingress of hot gas potentially leads to excessive thermal loading of the structure and to creeping, that is to say to further deformation. On account of this deformation, grazing of the sealing strips 15, 16, for example, on the opposite casing components occurs, and the service life of the turbomachine blade is noticeably shortened.

Figure 3:
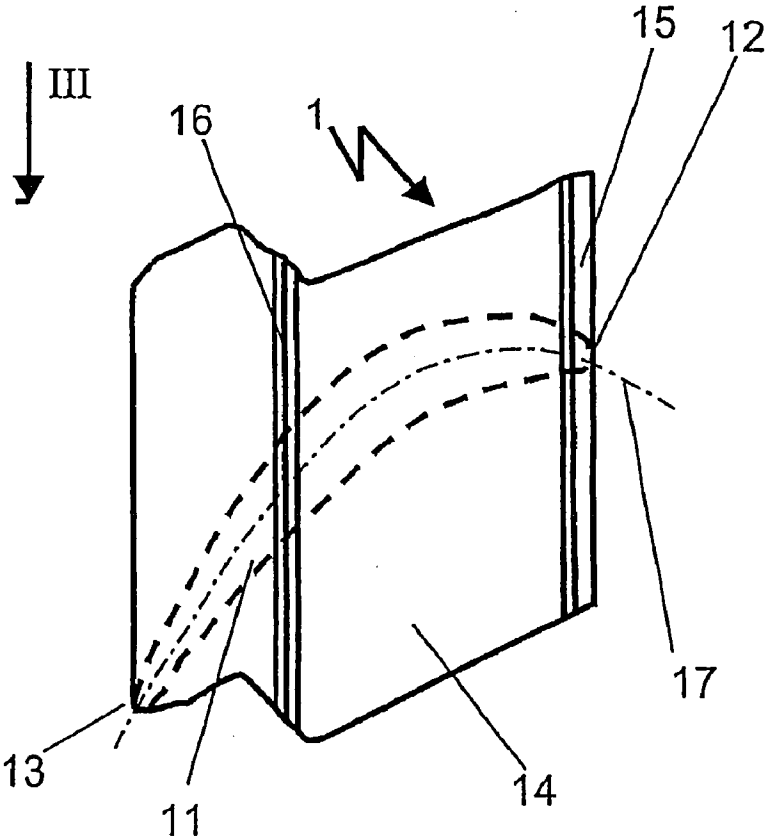
Fig. 3 Prior Art
FIG. 3 shows an exemplary individual turbomachine blade according to the prior art in a plan view.
Figure 2:
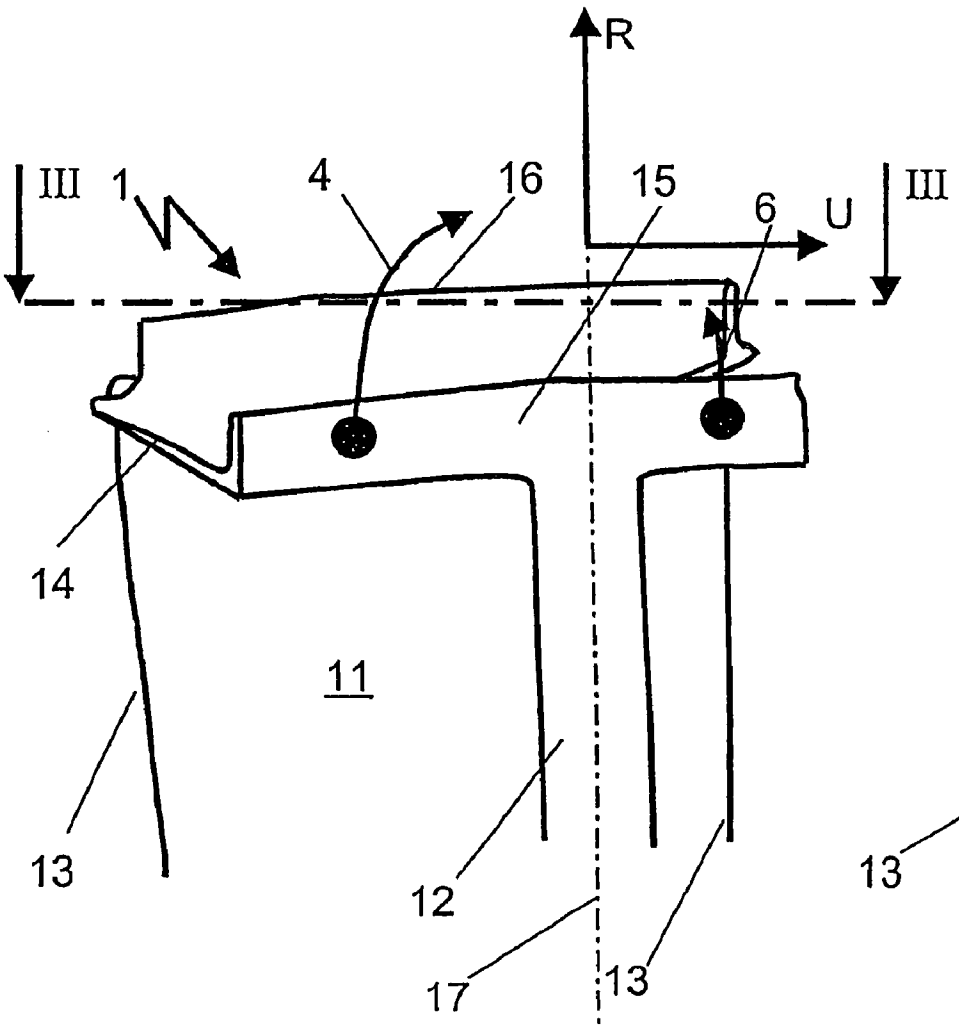
Fig. 2 Prior Art
FIG. 2 shows an exemplary individual turbomachine blade according to the prior art.

The process is explained in more detail below with reference to FIGS. 2 and 3. Here, FIG. 2 shows a perspective illustration of the blade tip region of the blade 1; FIG. 3 shows a plan view of the blade. The turbomachine blade has an installed radial direction R and an installed circumferential direction U. The airfoil median line is designated by 17. The airfoil median line may be regarded as a virtual axis of the tilting movement described above. On the suction side of the blade and on the pressure side of the blade, the mass moments of inertia of the shroud relative to this virtual axis are different. The centrifugal load of the shroud element during operation of the turbomachine results in a first bending moment 4 and a second bending moment 6. These bending moments are not evened out, in particular in the region of the airfoil leading edge 12 or the upstream sealing strip 15, in such a way that the described lifting of the shroud element on the blade pressure side occurs.

Figure 5:
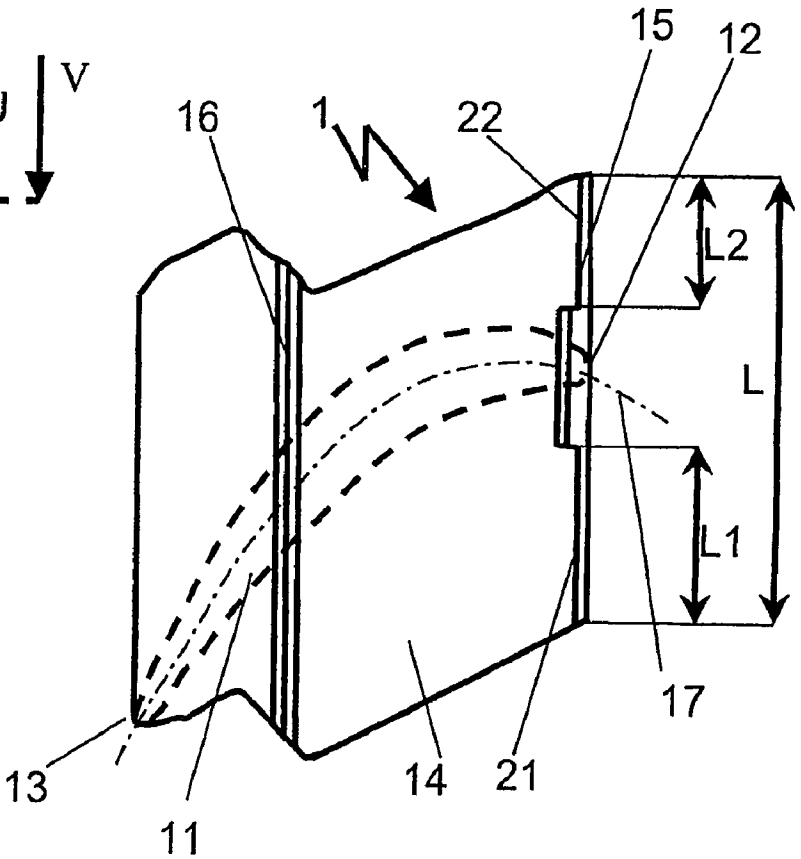
FIG. 5 shows an exemplary turbomachine blade in a plan view.
Figure 4:
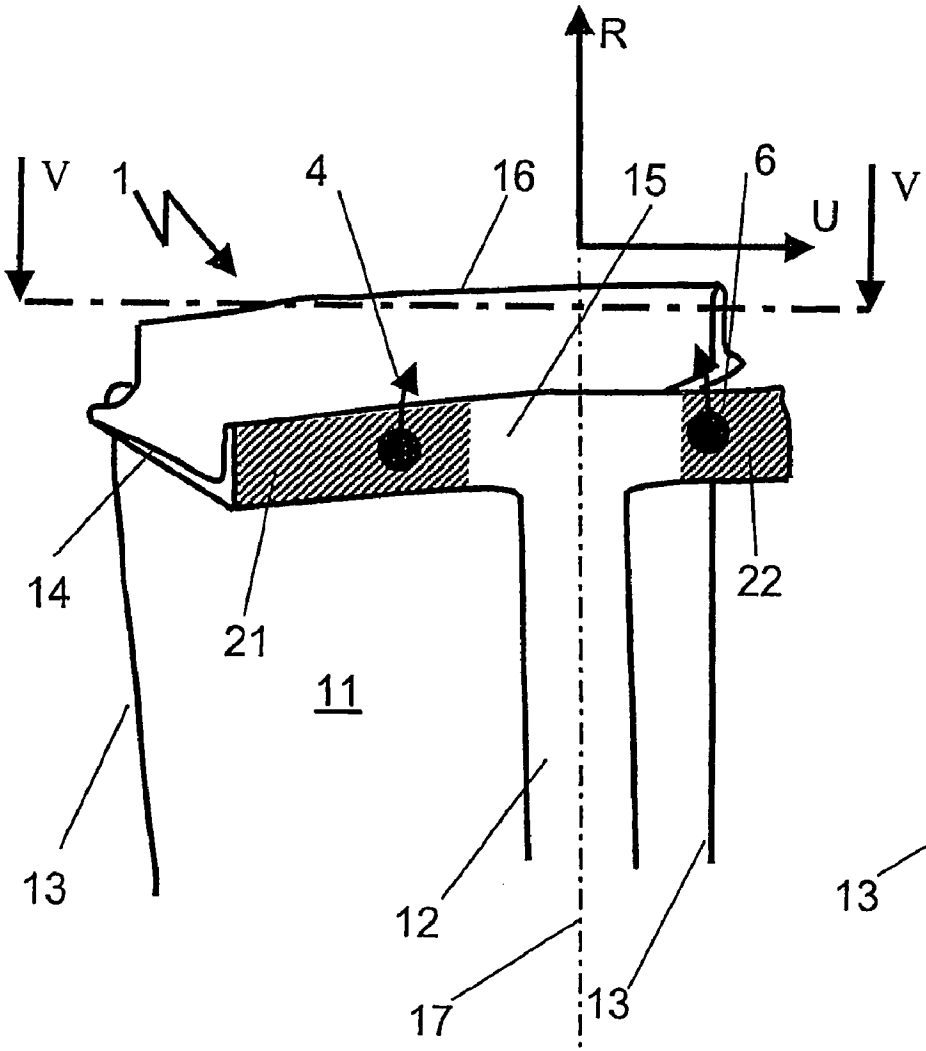
FIG. 4 shows an exemplary embodiment of turbomachine blade.

In the exemplary turbomachine blade shown in FIGS. 4 and 5, the thickness of the upstream sealing strip in regions 21 and 22 lying on the outside in circumferential direction U is reduced compared with a center region. As a result, the mass moment of inertia of the shroud element is reduced. That is to say that the bending moments caused by the centrifugal force during operation and thus the deformation are reduced.

In an exemplary ideal case, the reduction is effected in such a way that, at least in the upstream region, the shroud element is balanced relative to the airfoil median line in such a way that the bending moments resulting from the centrifugal forces are evened out; that is to say that the bending moment 6 resulting on the suction side and the bending moment 4 resulting on the pressure side neutralize one another.

The regions 21 and 22 of reduced thickness of the sealing strip extend over 20% to 70% of the extent of the sealing strip in the circumferential direction; that is to say the sum L1+L2 lies between 20% and 70% of the total extent L. On account of the reduction in the mass of the shroud element, the plastic deformation at the transition to the airfoil is at least reduced. Such a geometry of the sealing strip 15 can be produced, on the one hand, directly during the primary forming, for example during the casting or sintering, of the turbomachine blade. Furthermore, it can be produced by a forming process such as forging for example.

According to an exemplary embodiment, the turbomachine blade as shown in FIGS. 4 and 5 can be produced from a turbomachine blade of constant thickness of the sealing strip, as shown in FIGS. 2 and 3, by the sealing strip 15 being machined, that is to say, for example, by milling, grinding or electrical discharge machining. In the process, so much material is removed in the regions designated by 21 and 22 that the mass of the sealing strip can be reduced by, for example, 10% to 50% of the original mass. In this case, care is to be taken to ensure that the rigidity and strength of the sealing strip is retained. This production method can be especially efficient if the blades of existing machines are to be modified as described herein. It is then not necessary to fabricate new tools for the production of the blades, but rather only an additional machining step need be performed. This method is likewise especially suitable for the subsequent machining, of blades which are already in use during overhaul and/or maintenance measures.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Turbomachine blade
4 Tilting load, bending load
5 Hot-gas leakage
6 Tilting load, bending load
11 Airfoil
12 Airfoil leading edge
13 Airfoil trailing edge
14 Shroud element
15 Upstream sealing strip
16 Downstream sealing strip
17 Airfoil median line
21 Region of reduced thickness of the sealing strip
22 Region of reduced thickness of the sealing strip
L Circumferential extent of the shroud element
L1 Circumferential extent of a region of reduced thickness of the shroud element
L2 Circumferential extent of a region of reduced thickness of the shroud element
R Installed radial direction
U Installed circumferential direction, direction of rotation
Δ Lifting quantity

What is claimed is:

1. A turbomachine blade having a circumferential fitting direction and a radial fitting direction, comprising:

a blade root;

an airfoil;

a shroud band element; and a radial sealing strip, which runs in a circumferential direction, being arranged on the shroud band element which is arranged on a tip-side end of the airfoil, a thickness of which sealing strip varies in the circumferential direction such that the sealing strip has a first thickness at a position of the airfoil, and wherein the thickness of the sealing strip in regions lying on an outside as viewed in the circumferential fitting direction is smaller than the first thickness, wherein an inflow-side sealing strip and an outflow-side sealing strip are provided, and wherein only the thickness of the inflow-side sealing strip varies.

2. The turbomachine blade as claimed in claim 1, wherein the thickness of the inflow-side sealing strip varies such that a mass moment of inertia of the shroud band element relative to the airfoil median line is essentially evened out.

3. The turbomachine blade as claimed in claim 1, wherein a first region of the inflow-side sealing strip has a first thickness, a second region has a reduced thickness, wherein a region of reduced thickness of the inflow-side sealing strip is 20% to 70% of the extent of the sealing strip in the circumferential direction.

4. A method of producing a turbomachine blade having a circumferential fitting direction, a radial fitting direction, a blade root, an airfoil, a shroud band element, and a radial sealing strip, which runs in the circumferential direction, being arranged on the shroud band element which is arranged on a tip-side end of the airfoil, the method comprising:

forming a sealing strip in the circumferential direction such that the sealing strip has a first thickness at a position of the airfoil, and wherein the thickness of the sealing strip in regions lying on an outside as viewed in the circumferential fitting direction is smaller than the first thickness; and providing an inflow-side sealing strip and an outflow-side sealing strip, wherein only the thickness of the inflow-side sealing strip is reduced at least in sections.

5. The method as claimed in claim 4, wherein reducing the thickness of the inflow-side sealing strip is done by machining.

6. The method as claimed in claim 4, wherein the thickness of the inflow-side sealing strip is reduced at regions lying on an outside in the circumferential direction.

7. The method as claimed in claim 4, wherein between 20% and 70% of a circumferential extent of the inflow-side sealing strip is machined.

8. The method as claimed in claim 4, wherein a blade with an inflow-side sealing strip is used, the thickness of which is constant in the circumferential filling direction before the reduction.

9. The method as claimed in claim 4, wherein the thickness of the inflow-side sealing strip varies such that a mass moment of inertia of the shroud band element relative to the airfoil median line is essentially evened out.

* * * * *